US010302392B2

(12) United States Patent
Waters

(10) Patent No.: US 10,302,392 B2
(45) Date of Patent: May 28, 2019

(54) DIRECT MAGNETIC FIREARM HOLSTER

(71) Applicant: Steven Waters, Spokane, WA (US)

(72) Inventor: Steven Waters, Spokane, WA (US)

( * ) Notice: Subject to any disclaimer, the term of this patent is extended or adjusted under 35 U.S.C. 154(b) by 0 days.

(21) Appl. No.: 15/825,101

(22) Filed: Nov. 29, 2017

(65) Prior Publication Data

US 2018/0149447 A1 May 31, 2018

Related U.S. Application Data

(60) Provisional application No. 62/427,566, filed on Nov. 29, 2016.

(51) Int. Cl.

| | |
|---|---|
| ***F41C 33/02*** | (2006.01) |
| ***F41C 33/04*** | (2006.01) |
| ***H01F 7/02*** | (2006.01) |

(52) U.S. Cl.

CPC ..... *F41C 33/0272* (2013.01); *F41C 33/045* (2013.01); *H01F 7/0252* (2013.01); *F41C 33/0245* (2013.01); *H01F 7/02* (2013.01)

(58) Field of Classification Search

CPC .. F41C 33/0245; F41C 33/0236; F41C 33/02; F41C 33/0272; F41C 33/045; A45F 5/021

USPC ..... 224/185, 911, 912, 238, 243, 244, 913

See application file for complete search history.

(56) References Cited

U.S. PATENT DOCUMENTS

| | | | | |
|---|---|---|---|---|
| 2,910,804 | A * | 11/1959 | White | F41C 33/0263 2/300 |
| 4,450,992 | A * | 5/1984 | Casull | A44B 11/005 224/163 |
| 5,662,219 | A * | 9/1997 | Tschudy | A45C 13/02 150/113 |
| 6,616,020 | B1 * | 9/2003 | Spielberger | F41C 33/0245 224/183 |
| 6,732,891 | B2 | 5/2004 | Locklear, III | |
| 7,934,333 | B1 * | 5/2011 | Tuz | F41C 9/02 42/96 |
| 8,302,827 | B1 * | 11/2012 | Cole | F41C 9/02 224/243 |
| 8,403,278 | B1 | 3/2013 | Kasbohm | |
| 8,544,706 | B2 * | 10/2013 | Crye | F41C 33/045 224/193 |
| 9,297,612 | B2 * | 3/2016 | Schmadeka | F41C 33/048 |
| 9,746,299 | B1 * | 8/2017 | Davis | A45F 5/022 |
| 9,835,409 | B2 * | 12/2017 | Munz | F41C 33/0209 |
| 2006/0026886 | A1 | 2/2006 | Doukas | |
| 2007/0278266 | A1 * | 12/2007 | Parsons | A45F 5/02 224/197 |

* cited by examiner

*Primary Examiner* — Adam J Waggenspack
(74) *Attorney, Agent, or Firm* — KnuBox

(57) ABSTRACT

A firearm holster system and methods of use are described herein for safely securing a firearm while providing visibility and quick access. A shroud is provided in the rough shape of the firearm. One or more magnets attached to the shroud create a retaining force between the firearm and the shroud. The magnets in combination with the back and side walls of the shroud, provide protection and security to the firearm. The user simply accesses the firearm in a grip section of the shroud to remove it from the holster assembly.

13 Claims, 16 Drawing Sheets

DIRECT MAGNETIC FIREARM HOLSTER

CROSS REFERENCE TO RELATED APPLICATION

This application claims the benefit of U.S. provisional application Ser. No. 62/427,566 filed Nov. 29, 2016 by the present inventor, which is incorporated by reference in its entirety.

STATEMENT REGARDING FEDERALLY SPONSORED R&D

Not related to this application.

TECHNICAL FIELD

This invention relates to firearm holsters, and more particularly to holsters that secure a firearm without a user having to insert a barrel into a pocket.

BACKGROUND OF THE INVENTION

Holsters are well established and mature in the art of firearms and personal protection. Generally, holsters are attached to a person for the purpose of storing and accessing a firearm.

Firearms come in many varieties, with common types being rifles and pistols. For centuries, people have carried firearms for personal protection from animals and other people. Policeman, government officers, and military personal carry firearms as part of their job function and duties. Holsters are a common method for securing a firearm to a person, allowing close proximity storage and quick access it if needed.

Traditionally guns have been made from metallic materials, such as steel. Weight has been reduced and comfort increased through the use of wooden and plastic frames and grips. Today, it is not uncommon for firearms to be made of advanced materials, including plastic and non-metallic components. For example, a firearm frame may be made of non-metallic components, have a metallic barrel, and components assembled with high strength metallic pins.

Traditional waist style holsters are typically clipped to a belt and comprised of a downward facing pouch. The pouch is manufactured to the oversized and general shape of the barrel section of the gun to be stored. The handle, or grip, of the firearm is exposed. To store a firearm, a user raises their elbow to get the barrel to point downward at the pouch. The user then inserts the barrel into the pouch, pushing down and releasing their hands from the grip. In some versions, a strap is applied over the grip, or frame, to ensure the firearm is retained and does not fall out during activity. When access to the firearm is needed, the user releases the securing strap and places their hand on the grip of the firearm. By the user raising their elbow and arm, the barrel of the firearm is removed from the holster and the user can begin to aim by rotating their arm in the forward direction. There are several sequential body movements that must be coordinated to store and access the firearm. Although not critical during the storage process, the delay in performing these movements are a delay in aiming and can increase personal risk in time sensitive protection situations. In addition, safety straps can delay a user aiming their weapon. Another problem with the prior art is that the movement of inserting a barrel during storage can cause accidental firing as the trigger motion is aligned with the insertion motion of the firearm. Although fine for general storage, prior art "pouch style" holsters are less than optimal for time sensitive protection situations.

There are prior art devices optimized for particular applications. One such device is described by U.S. Pat. No. 2,910,804 to White. The White reference is directed at making it easier to remove a firearm from a person's body in non-personal protection situations. A firearm is inserted into a pouch, and the pouch is magnetically attached to a plate mounted to a user. In situations where someone desires to store their firearm without intending to use it, the pouch can be separated from the plate with the firearm remaining inserted in the pouch. The advantage of the White reference is that the firearm is still protected when placed on a surface in storage. In consideration of usefulness in a personal protection situation, the White reference provides no advantage as the firearm must be withdrawn just the same as a traditional holster. In fact, the White reference can actually create negative consequences in a personal protection situation as during withdrawal the pouch can accidentally be separated from the plate, rather than the firearm being withdrawn from the pouch. In this case, the user must use a hand to remove the pouch from the firearm prior to aiming.

Another prior art improvement is described by U.S. Pat. No. 6,732,891 to Locklear. This holster is directed at the security of a firearm stored in a holster and describes a releasable lock mechanism that retains the firearm within the holster. While potentially improving security, the Locklear reference adds complexity, cost and can delay response times of a user.

Yet another approach to improving the usefulness of prior art holsters is the concept of a magnetic holster, wherein a magnet is placed within a traditional pouch to help keep the firearm secured within the pouch. While potentially useful for reducing the need for a traditional safety strap for securing a firearm to a holster, magnets within a pouch do not provide advantages for providing visibility and quicker access to the firearm in personal protection situations.

Yet another prior art device is U.S. Pat. No. 8,403,278 to Kasbohm which describes a magnet that can be attached to a surface and to a firearm. Such magnetic devices are useful to storing a firearm under a nightstand or in a car, but they are not useful in storing a firearm to a user. Storing a firearm to a remote object, such as described by the Kasbohm reference, increase the user response time in time sensitive personal protection situations as the user must locate the firearm prior to gaining access. The Kasbohm reference is unpractical for use in attaching a firearm to a user, as movements of the user such as bending, running or twisting can cause the firearm to be dislodged from the magnet or to cause the firearm to rotate with respect the magnet causing firearm scratching and wear. A rotated firearm makes use slow and problematic in a personal protection situation. To potentially fix this limitation, the magnetic force required to keep a firearm stationary would be too large to be comfortable, light weight and the large retaining forces would delay response times in a personal protection situation.

In these respects, the present invention departs from conventional concepts of the prior art in the mature art of firearms by providing a direct magnetic holster that results in a user being able to more safely store a firearm in addition to reducing time required to withdraw and aim a firearm in a time sensitive personal protection situation. The present invention provides a low cost and simple way to safely store, transport and access a firearm.

SUMMARY OF THE INVENTION

The present invention takes a very different approach to storing, transporting and accessing a firearm in comparison to the prior art.

The present invention is a holster for a firearm. The holster provides novel ways to secure a weapon with improved security of the trigger, improved visibility and faster access to the firearm than the prior art. Prior art holsters are generally a pocket shape wherein a substantial portion of the firearm, starting with the muzzle end, is inserted into the length of the pocket. Prior art firearm holsters protect the firearm, but do not provide for the advantages of the present invention. The present invention does not utilize a pocket, but rather a shroud and magnets. The shroud is in the general shape of the firearm and provides stability in two directions and the magnets create a retaining force in the third direction. The magnets are placed to provide a good retention force during storage, but also enable easy access to the firearm when desired.

An object of the invention is to create storage of a firearm without requiring the barrel of a firearm to be inserted into a pouch. A firearm containing metallic materials is secured to a shroud using magnets.

An object of the invention is to create faster response times that the prior art by allowing a user to withdraw their firearm in a forward aiming direction without complex and wasted motions.

An object of the invention is to increase safety of stored firearms over the prior art. The present invention utilizes optional trigger protection protrusions that keep the firearm trigger from moving once placed in the shroud of the present invention. A trigger protection protrusion does not allow a user's finger to access the trigger when the firearm is placed in the shroud of the present invention. The novel side retention by the present invention allows a firearm to be stored with one or more trigger protrusions that improves safety over the prior art.

An object of the present invention is to be more comfortable than the prior art. The present invention includes a shroud having a rotatable clip that allows the user to store their firearm close to the bending point of their waist, and in an optimal orientation.

An object of the present invention is to create less wear on a firearm than the prior art. The present invention utilizes a shroud that allows a firearm to be laid up against it without having to insert the barrel into a friction creating pouch.

These and other features, aspects, and advantages of the present invention will become better understood with regard to the following description, appended claims, and accompanying drawings.

BRIEF DESCRIPTION OF THE DRAWINGS

Preferred embodiments of the invention are described below with the reference to the following accompanying drawings:

FIG. 4 also shows optional tabs, or a capture wall that provides added retaining which may be suitable for particular firearm versions and styles.

DETAILED DESCRIPTION OF THE PREFERRED EMBODIMENTS

Many of the components utilized in this invention are widely known and used in the field of the invention, and their exact nature or type is not necessary for a person of ordinary skill in the art or science to understand the invention; therefore they will not be discussed in detail. In more detail, it is appreciated that firearms are a well-known art and thus the exact features are not needed for one to understand and practice the invention without undue experimentation, and thus will not be described in detail.

Figure 1:
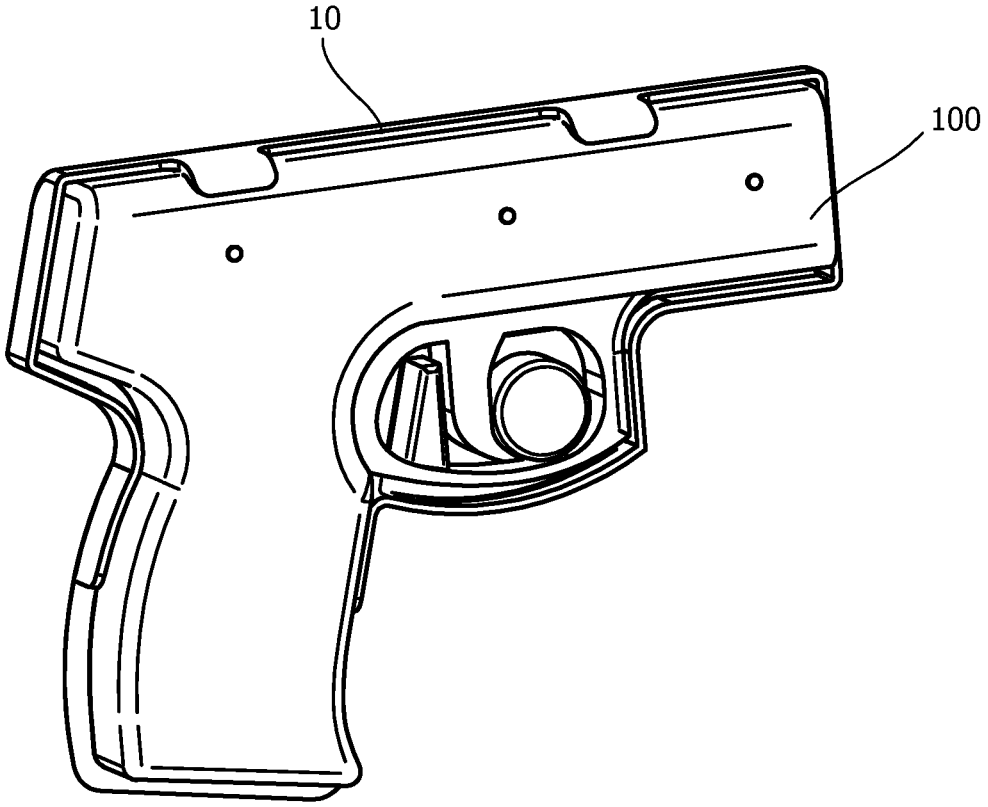
FIG. 1 is a perspective view of a novel firearm holster assembly, according to the present invention. The holster is shown with a firearm in the secured position.

As shown in FIG. 1, the present invention is comprised of a holster assembly 10 which is used to secure a firearm 100. Although a handgun is shown as part of the best mode, the present invention should not be construed to be limited to the handgun version shown. It is also well known in the art of firearms that a handgun is one version of firearm and many other styles and versions exist. The spirit and scope of the present invention includes common firearm types including but not limited to rifles, revolvers, and pistols, which may be single shot, semiautomatic or automatic. The present invention describes multiple embodiments and optional features that may be applied to a particular firearm style or model.

Figure 2:
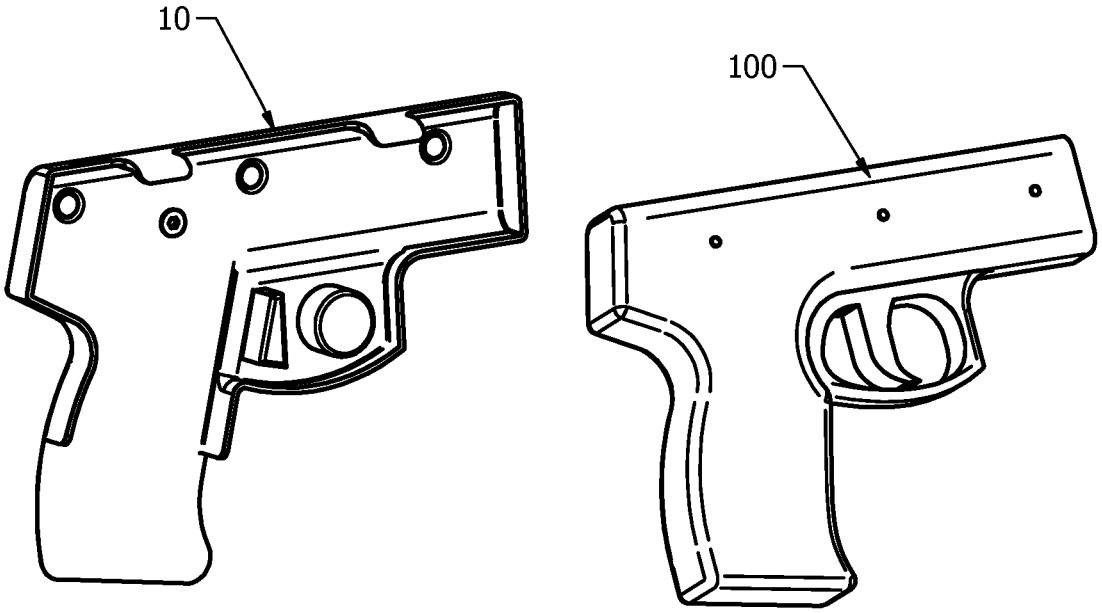
FIG. 2 is a perspective view of the firearm holster of FIG. 1, and showing the firearm in a removed state.

The general concept of the present invention is best shown in FIG. 2. Novel holster assembly 10 is used to secure firearm 100 when not in use and to provide quick access when needed. Holster 10, according the preferred embodiment of the present invention, is attached to a person. The preferable place to mount holster 10 to a person is on the hip or abdomen area which can be accomplished by attaching holster 10 to pants, a waistband, or belt. Although the waist area is the preferred embodiment of the present invention, it should not be construed to be limited to such. Alternatively, the present invention can be utilized on other body areas, such as the chest, ankle, and thigh. In addition, the present invention is not limited to securing firearm 100 to a person. Holster 10 can be used to secure firearm 100 to a surface of an object such as a bed frame, night stand, automobile or other common object. Holster 10 may be sewn into clothing, luggage, bags and other textiles. The benefits of the present invention are not limited to any particular application. Holster 10 provides a safe and secure method for storing firearm 100 while providing visibility and quick access.

Figure 3:
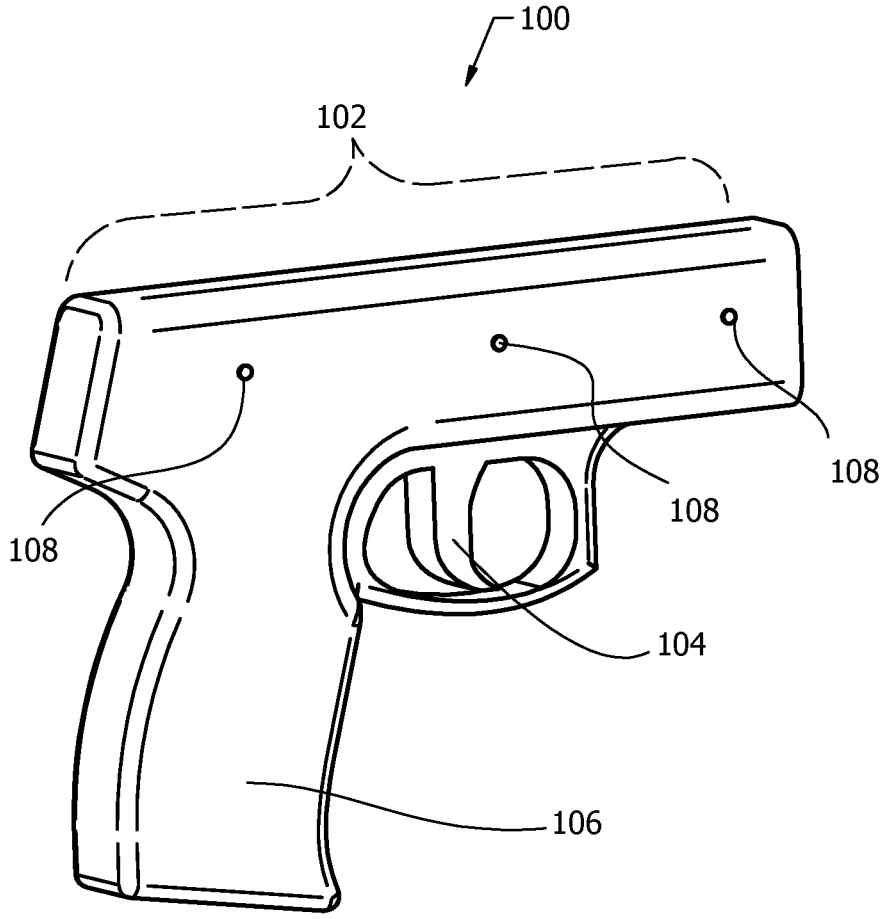
FIG. 3 is a front perspective view of the firearm of FIG. 1 and showing sections of the firearm. The firearm of FIG. 3 is just one example of a firearm that can be utilized by the present invention.

FIG. 3 shows firearm 100 having a barrel section 102, a trigger 104, and a frame 106. Again, firearms are commonly understood and do not need to be discussed in significant detail for one skilled in the art to understand and practice the present invention. Barrel section 102 extends substantially the length of firearm 100 and typically includes a metallic chamber for aligning the bullet or projectile. Barrel section 102 may also be referred to as the "slide section" for certain style firearms. Frame section 106, including a handle or grip, and is used by the operator to align barrel section 102 in the desired direction and provides a resistance for the user's hand to pull against when activating trigger 104. Typically, sections of firearm 100 are connected with one or more metallic pins 108. Pins 108 are shown on the outside surface of firearm 100, but either extend through the width of firearm 100 or a matching set is on the opposite (not shown) side of firearm 100.

Figure 10:
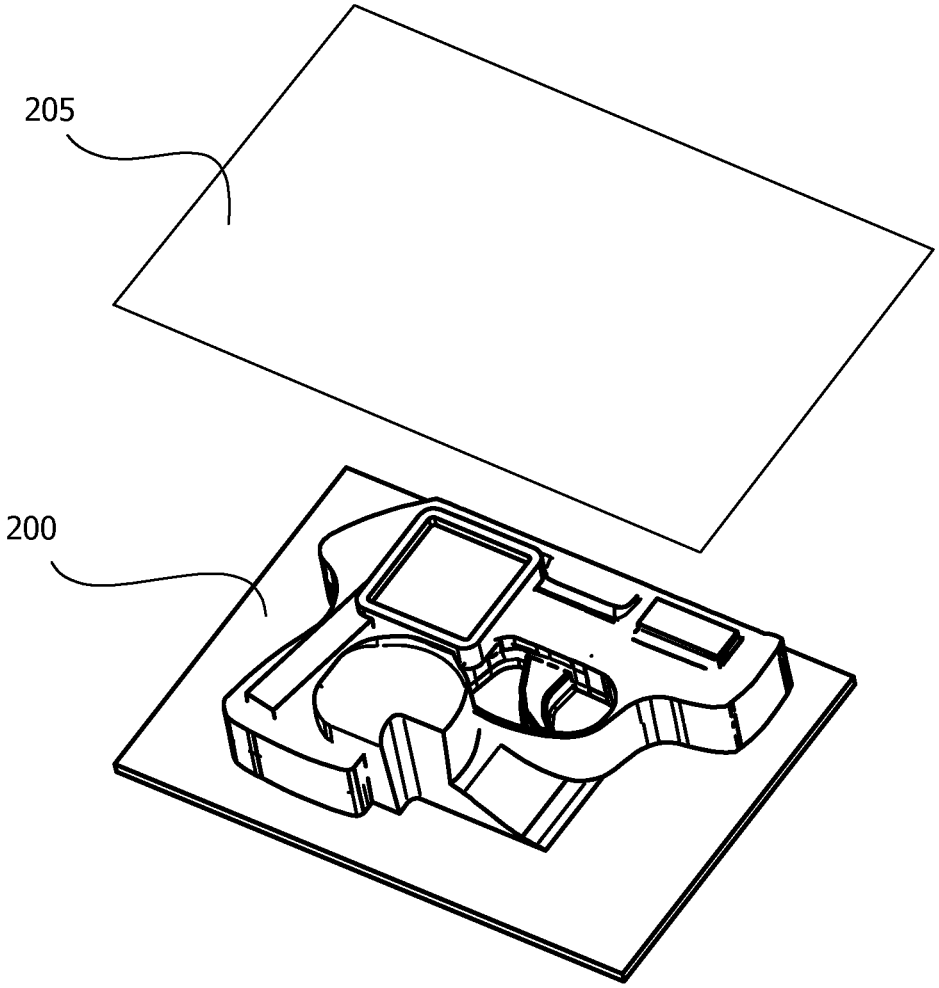
FIG. 10 is a top perspective view of an example manufacturing method utilizing vacuum forming.

Holster assembly 10 is comprised of a shroud 20, and a clip 40. Shroud 20 is formed in the general 3D shape of firearm 100 and is preferably made from plastic, and formed via thermoforming. Alternatively, shroud 20 may be constructed by one or more injection molded pieces, or made from one or more common machining processes. According to the best mode of the present invention, shroud 20 is made from a thermoformable plastic commercially available by the trade name "Kydex". As shown in the FIG. 10, a mold 10 is created by either 3D printing, machining or molding. A hot plastic sheet 205 is placed against mold 200 and either vacuum or pressure is applied to sheet 205 to form it to mold 20. After cooling, sheet 205 is in the desired shape of firearm 100 and excess material, along with mounting holes, are machined or routed. It should be appreciated that according to the preferred embodiment, protrusions and features of shroud 20 can be made to closely fit firearm 100. Unlike the prior art, the present invention is not a general shaped pouch, but rather shroud 20 is a close fit to the 3D shape of firearm 100. Through the molding process, a left hand version of shroud 20 can be made in addition to the right hand versions shown in the drawings. A left hand version of shroud 20 may be a mirror image of the right hand version, but for many styles and versions of firearm 100, the left side version of shroud 20 will have a unique profile due to the presence of unique features on the right side of firearm 100. Unique features may be, but is not limited to, a depression around a safety lock or ejectors from the barrel section 102. It should also be appreciated that firearm 100 is intended to include any accessories that make firearm 100 useful for a particular user or application. For instance, a common accessory may be an extend capacity ammunition clip, a scope, or a laser tracer. Shroud 20 is intended to be formed to the shape of firearm 100 which may include either side of firearm 100 and any accessories mounted to firearm 100.

Figure 4:
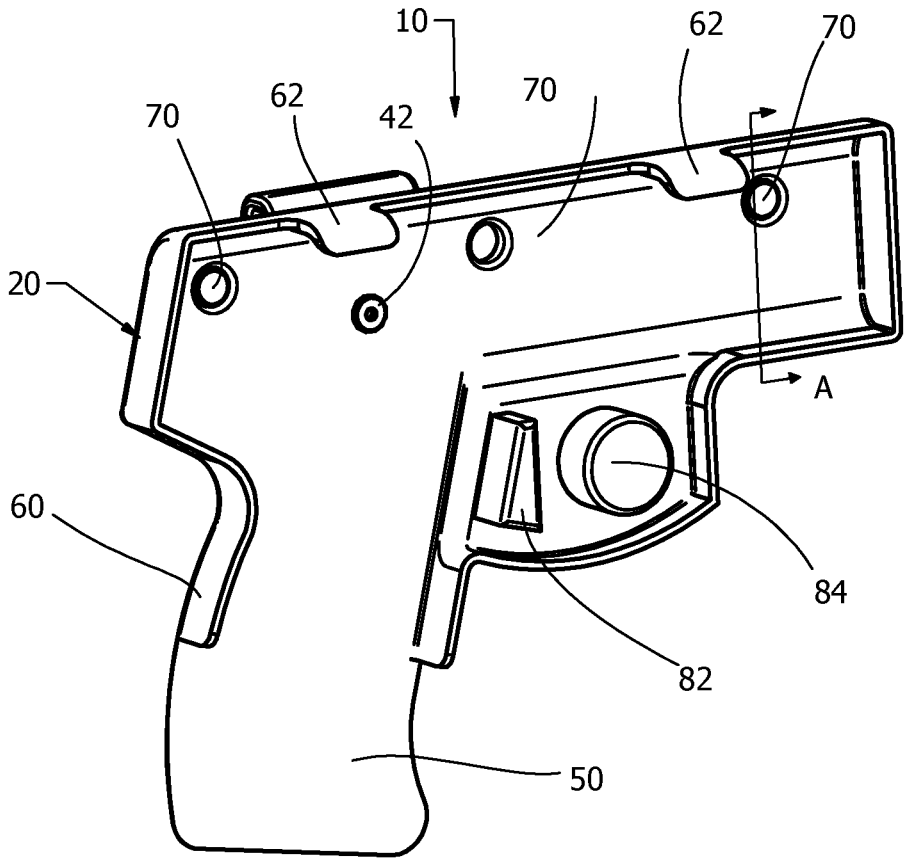
FIG. 4 is a front perspective view of the firearm holster of FIG. 1 and showing retaining and trigger protection protrusions.
Figure 5:
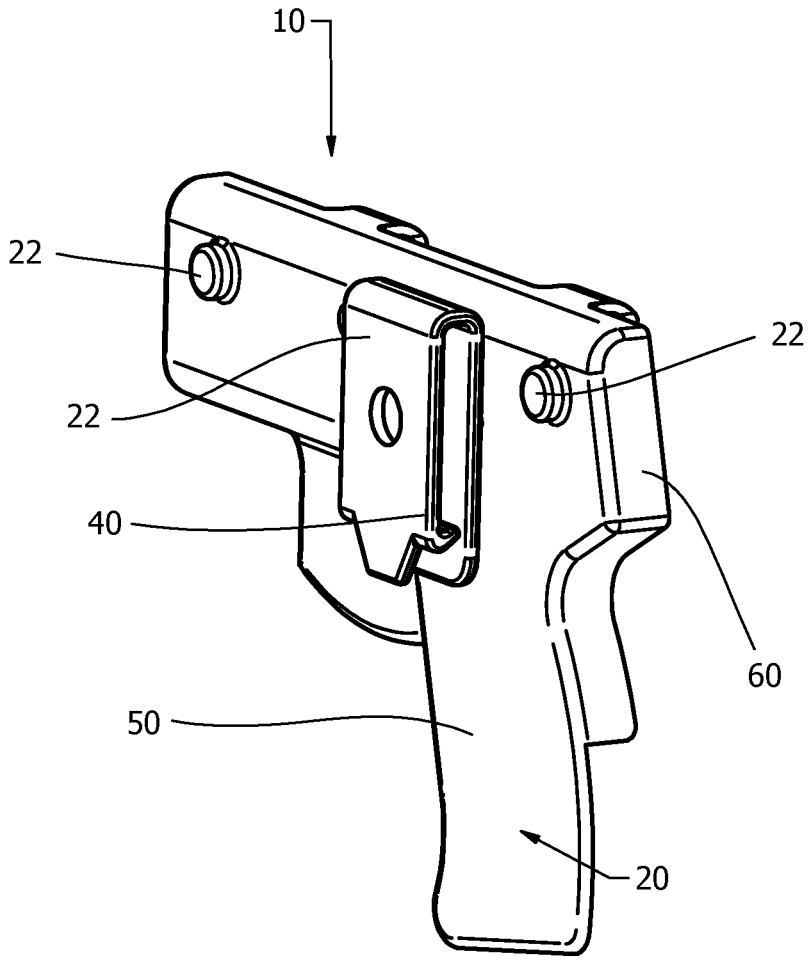
FIG. 5 is a back perspective view of the firearm holster of FIG. 1 and showing magnetic recesses and one version of a mounting clip.
Figure 11:
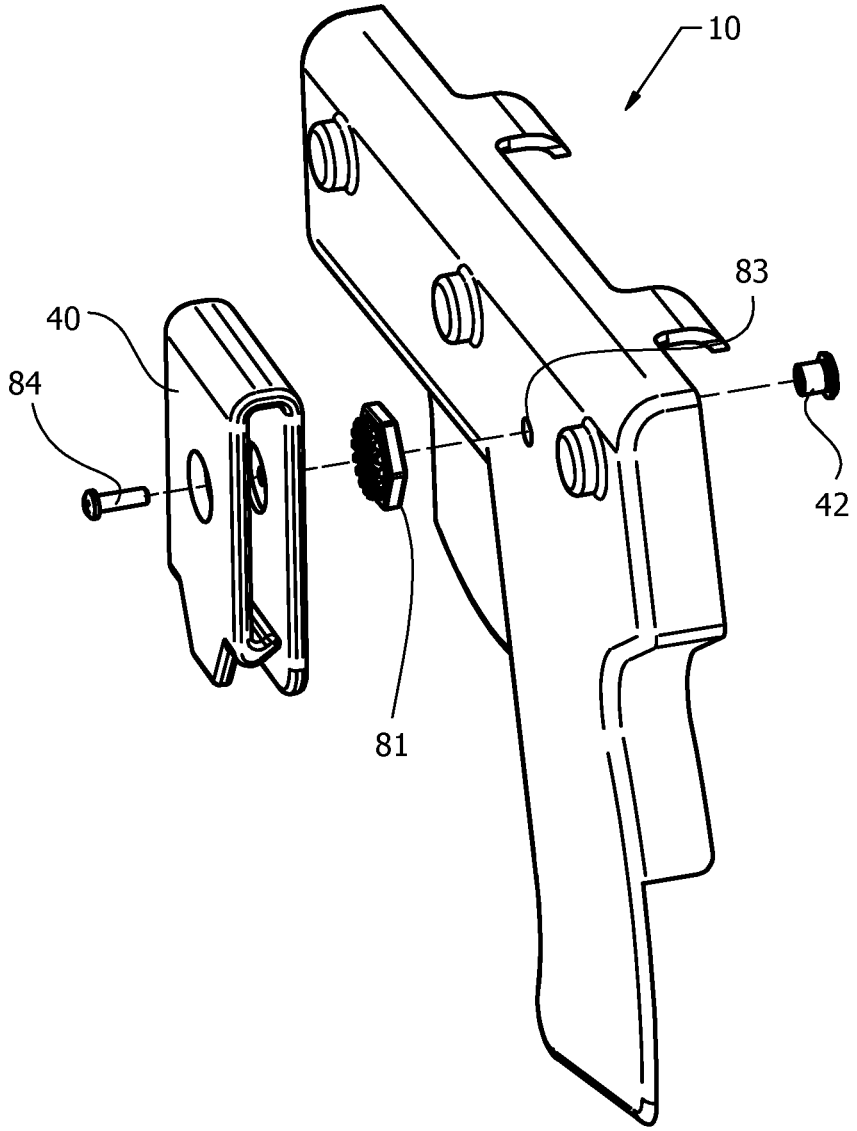
FIG. 11 is a side perspective view of the holster assembly showing the assembly of a clip to the shroud.
Figure 12:
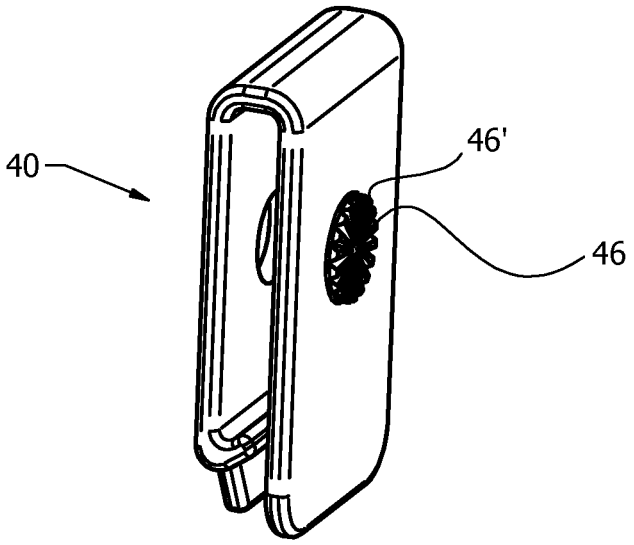
FIG. 12 is a side perspective view of a clip location feature for controlling rotation between the shroud and clip.
Figure 13:
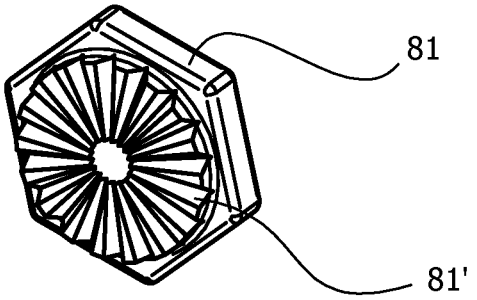
FIG. 13 is a perspective view of a holster location feature for engaging with the clip location feature of FIG. 12.
Figure 14:
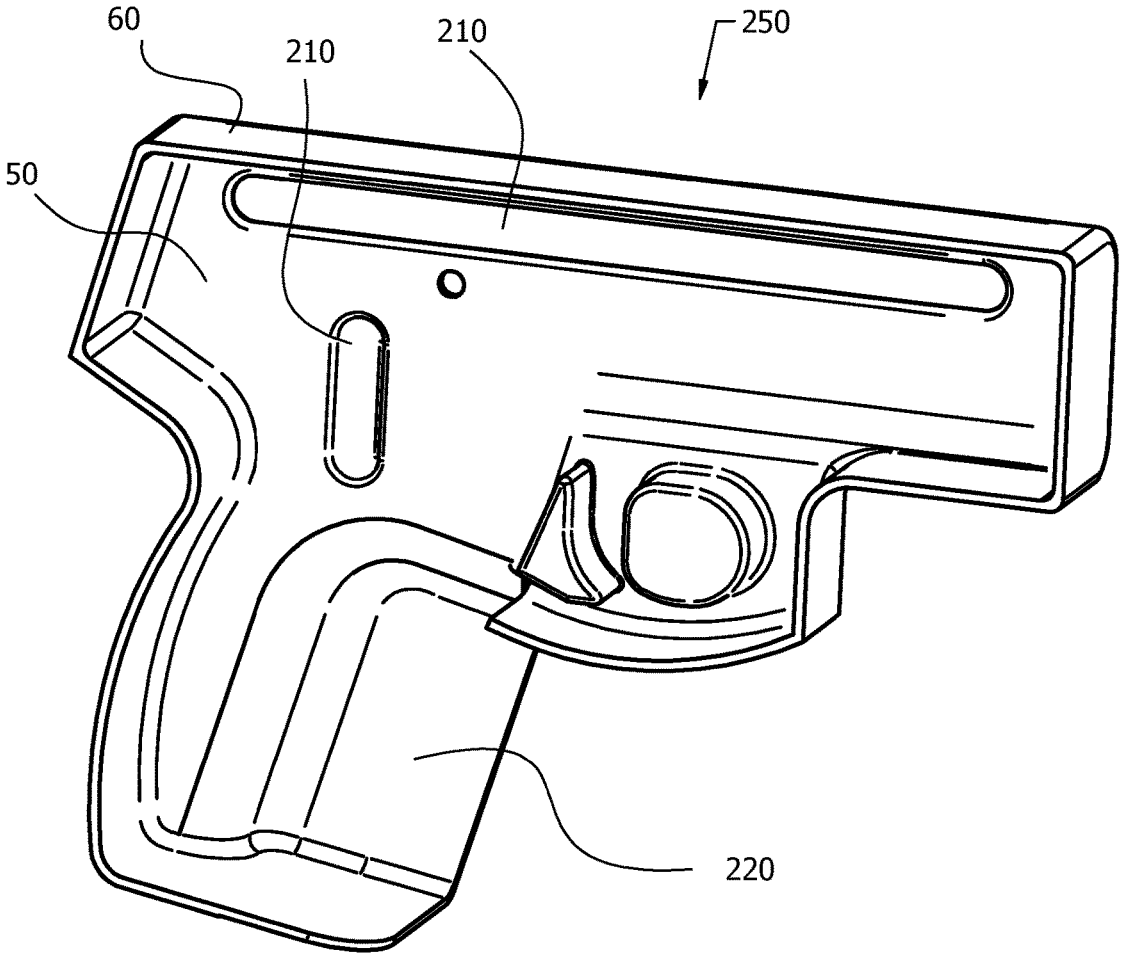
FIG. 14 is a front perspective view of an alternative embodiment access shroud, showing a full depth side wall, an access section and rectangular magnets.
Figure 15:
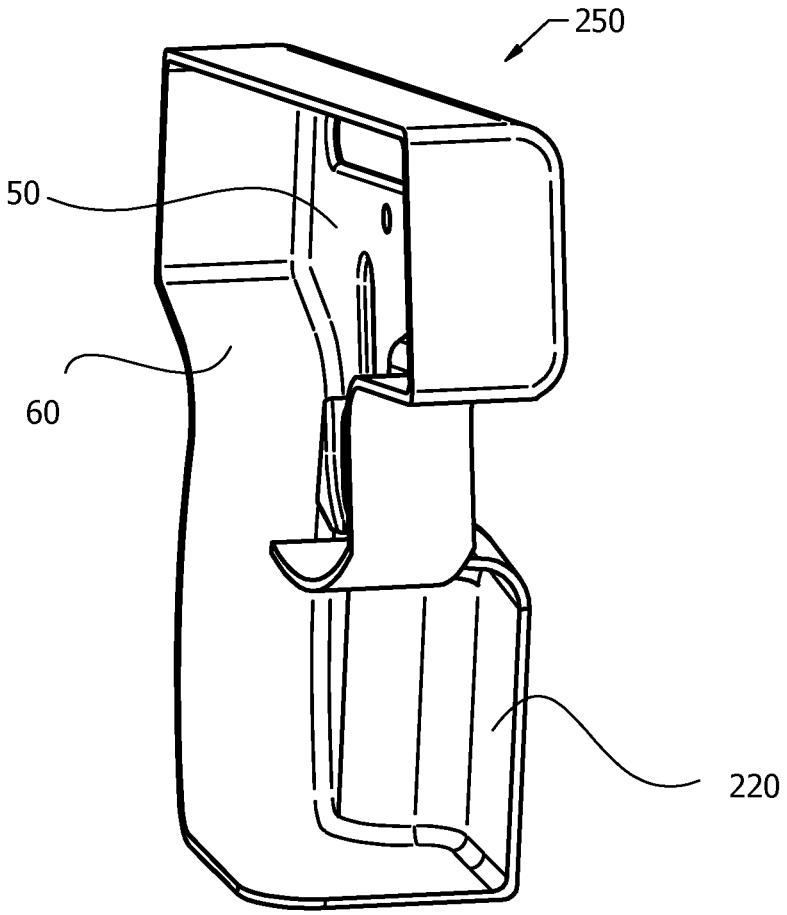
FIG. 15 is a side perspective view of the alternative embodiment access shroud of FIG. 14.
Figure 17:
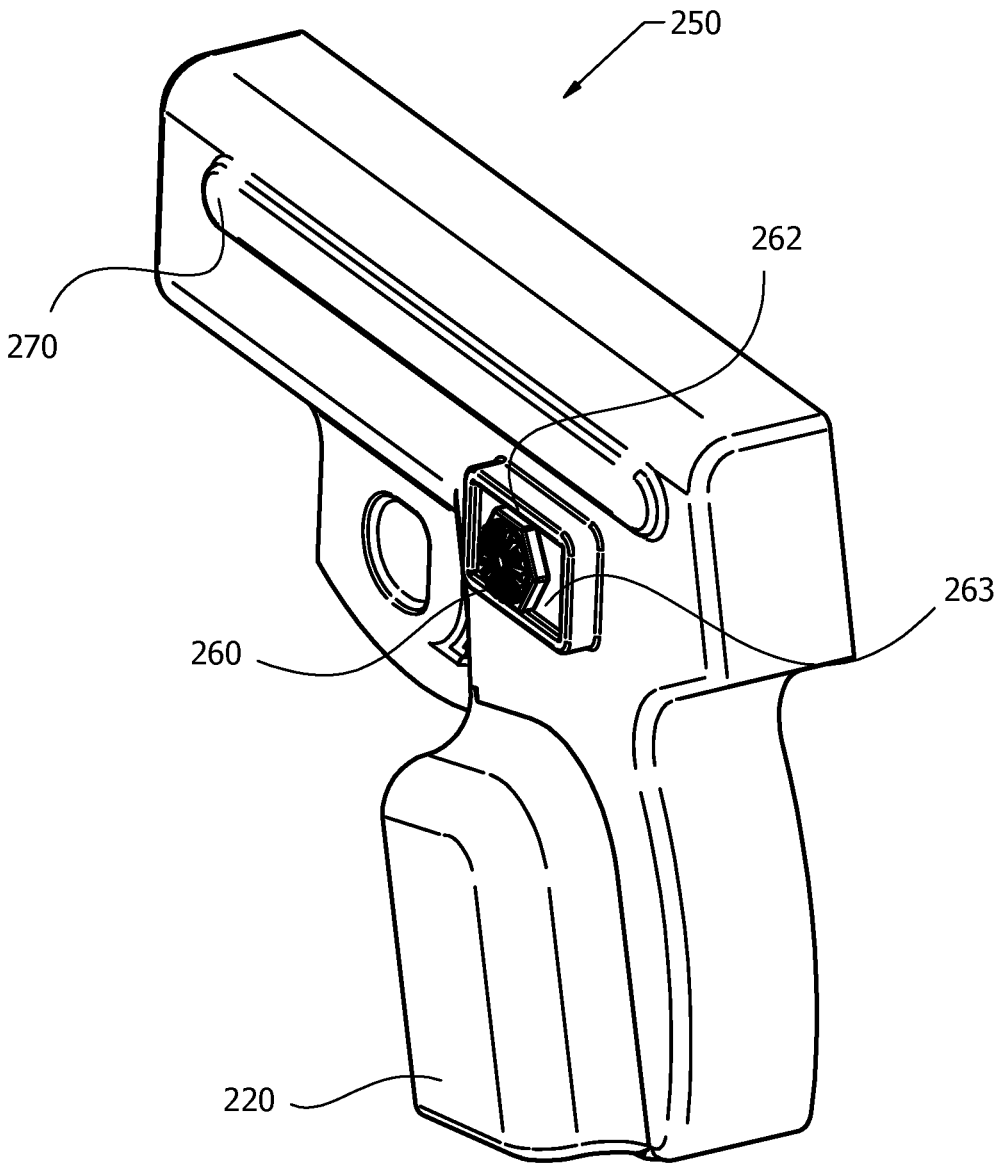
FIG. 17 is a back perspective view of the access shroud of FIG. 14 and showing a raised mounting protrusion and molded holster locator.

As shown in FIG. 4, shroud 20 has a main section 50 which makes contact with the side of firearm 100 and is used to secure clip 40 via fastener 42. A mounting hole 83 allows a screw 84 to capture clip 40 and to engage with fastener 42. Fastener 42 may be, but is not limited to, a nut, internally threaded fastener, or self-clinching standoff. Although clip 40 may be any common mounting method, such as but not limited to a strap, channel, loop, or article of fabric, according to the preferred embodiment clip 40 is a flexible clip as shown in FIGS. 11 and 12. Clip 40 is preferably made of plastic which easily allows flexing and displacement of its shape. An angled lead-in allows a user to push down over a belt or pant waist. Also according the preferred embodiment of the present invention, clip 40 includes a clip locating feature 46 which is comprised of a circular array of ridges 46'. A holster locator 81 includes a corresponding array of holster ridges 81', which with a small amount of clamp pressure between screw 84 and fastener 42 fixes clip 40 with respect to shroud 20. Loosening screw 84 allows circular array of ridges 46' to not engage holster ridges 81' and to allow clip 40 to rotate with respect to shroud 20. FIG. 17 shows an alternative embodiment method for securing clip 40 to an alternative embodiment access shroud 250. A molded holster locator 260 is shown wherein holster ridges 81' are formed into shroud 250, which is applicable to all embodiments of shroud 20 described herein. An optional raised mount protrusion 263 is shown for moving molded holster locator 260 or holster locator 81 to the desired location away from main section 50 to optimally clip holster assembly 10 to a user's body for a particular style of firearm. Again optionally, a raised holder wall 262 may be formed to constrain holster locator 81 by providing one or more surfaces in close proximity to holster locator 81. It should be appreciated that the mounting methods described herein are provided to teach ways to adapt the present invention to particular styles and models of firearms. The present invention should not be construed to be limited to any particular clip style or mounting methodology.

Shroud 20 has an optional outside wall 60 which partially or completely surrounds the perimeter of firearm 100. Height, length and location of outside wall 60 can be optimized for particular models and styles of firearms. Alternative embodiments and their accompanying figures show different example versions of outside wall 60 which may be adapted to particular versions of the present invention. The present invention should not be construed to be limited to any particular length, height or shape of outside wall 60. Outside wall 60 extends from main section 50 in the direction of firearm 100. Shroud 20 secures firearm 100 in the two directions within the plane of main section 50. Optionally, a one or more capture wall 62 extends from outside wall 60 and can provide additional capturing of firearm 100. Capture wall 62 may be excluded or more than two used, and placed anywhere around the perimeter of firearm 100 in a fashion optimized for different versions of firearm 100. Because the example version of firearm 100 has a substantially flat frame 106, main section 50 is shown predominantly flat. It should be appreciated that different guns have different shapes and that shroud 20 is preferably molded to the actual 3D shape of firearm 100 with a small offset for insertion and removal clearance. For some versions of firearm 100, shroud 20 may be a complex non-planer shape with main section 50 and outside wall 60 blended together. Unlike the prior art that captures a firearm by securing to its barrel, shroud 20 captures the side profile of firearm 100.

Optionally, part of shroud 20 includes a trigger stop protrusion 82 and a trigger block protrusion 84. Trigger stop protrusion 82 is just behind trigger 104 and keeps trigger 104 from moving towards the firing position while firearm 100 is in the secured position against shroud 20. In front of trigger 104, trigger block protrusion 84 provides additional safety by occupying the space in front of trigger 104. A user's finger is unable to move trigger 104 with firearm 100 secured in holster assembly 10. Trigger stop protrusion 82 and trigger block protrusion 84 are shown molded part of shroud 20, but it should be appreciated that stop 82 and block 84 may be manufactured as separate pieces and attached to shroud 20. It should also be appreciated that stop 82 and block 84 are part of the best mode of the present invention, but are not required. Stop 82 and block 84, in combination with shroud 20, provide the means of providing increased safety over prior art gun holsters.

Preferably located in the top half of shroud 20 are a one or more magnet cavity 22 containing a one or more magnet 70. Magnet 70 can be attached via glue, fasteners or co-molded to shroud 20. Preferably magnet 70 has a high magnetic flux density and testing has shown that three roughly 0.25 inch diameter magnets can provide acceptable retention force of a small handgun. Although cylindrical shaped magnets are preferable and part of the best mode of the present invention, the present invention should not be construed to be limited to any type or shape of magnet. For example, a magnetic strip may be suitable for some applications and is shown in FIG. 17. A rectangular slot 270 creates a space for a rectangular magnet 210. Rectangular magnet 210 may be a strip with rounded ends. Rectangular magnet 210 may be optimal for some firearm styles and models that do not have predictable locations of magnetic materials.

Figure 8:
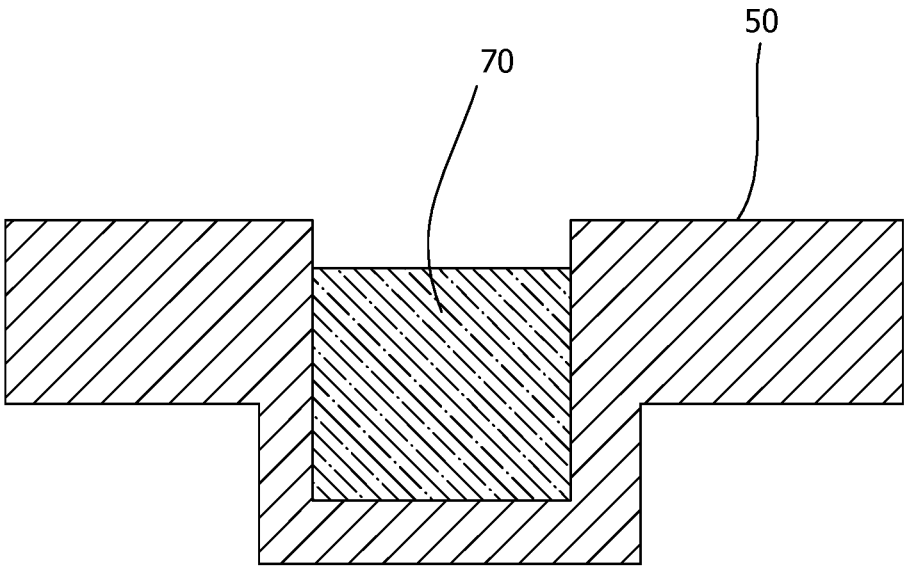
FIG. 8 is a section view through section line A of FIG. 4 and shows the shroud of the firearm holster and how a magnet is preferably below or equal to the front surface of the shroud.

Magnet 70 is located in close proximity to metallic members of firearm 100, usually in the proximity of barrel section 102 which may contain steel and magnetic stainless steel. Magnet 70 may also be located in close proximity to metallic pins 108 of firearm 100. As shown in the cross section view of FIG. 8 and part of the preferred embodiment of the present invention, magnet 70 is just below the top surface of shroud 20, and surface 50, as to not make direct contact with firearm 100. This keeps one or more magnet 70 from potentially scratching firearm 100. Alternatively, one or more magnet 70 may be covered with a rubber or plastic material providing contact protection.

With one or more of magnet 70 in close proximity to magnetic materials of firearm 100, firearm 100 is secured to shroud 20 in a third direction. Combined, shroud 20 and one or more magnet 70 retain firearm 100 in three axis and provide the means to secure firearm 100 to holster assembly 10 by just laying firearm 100 against shroud 20.

Figure 7:
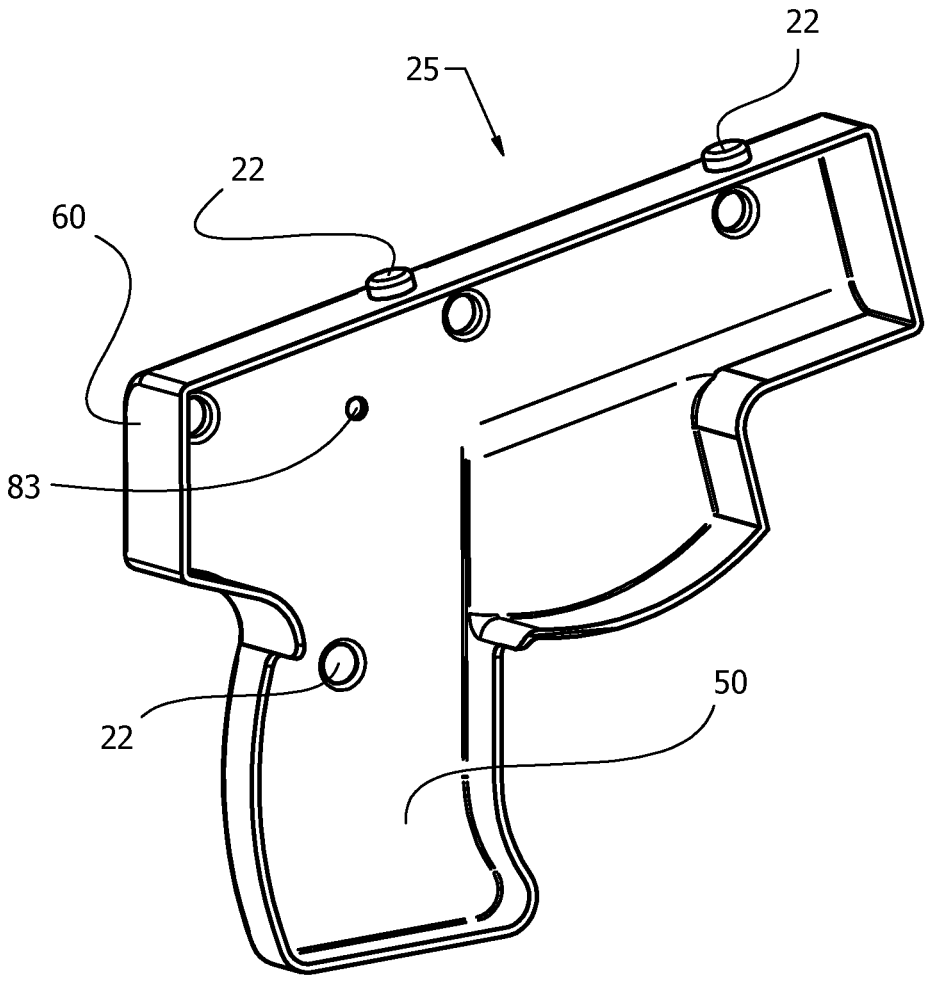
FIG. 7 is a front perspective view of a deep shroud alternative embodiment of the present invention. Optional trigger protection protrusions are excluded.

FIG. 7 shows an example alternative embodiment of the present invention. A protective shroud 25 has outer wall 60 extending completely around main section 50 and having a variable depth ranging from more than the depth of firearm 100 to partially extending the depth. Such an embodiment may be useful to provide additional protection and security for a particular version of firearm 100, especially in the area of frame 106. The present invention should not be limited to any particular configuration of outside wall 60.

Figure 9:
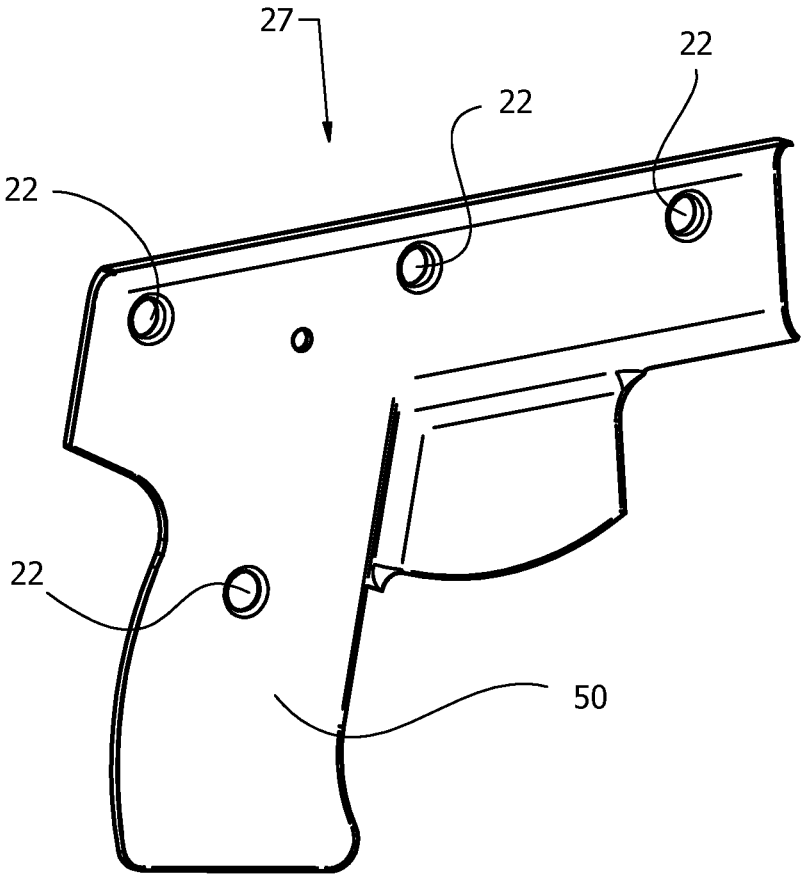
FIG. 9 is a front perspective view of shallow shroud alternative embodiment of the present invention.

For further example, an alternative embodiment of the present invention may include a shallow version of shroud 20. As shown in FIG. 9, shallow shroud 27 is shown with main section 50 and has little or no outer wall 60. Shallow shroud 27 may be useful for a particular style or version of firearm 100.

FIG. 7 also shows an alternative embodiment of not having capture wall 62 for facilitating retaining of firearm 100. The present invention may have none, or more than one capture wall 62 as needed to adequately secure firearm 100 and to facilitate use.

FIG. 7 also shows the present invention is not limited to any number or location of magnet 70. With some versions of firearm 100, it may be desirable to locate a magnet 70 in the area of frame 106 or trigger 104. As shown in FIG. 7, magnet cavity 22 may be in close proximity to any metallic member of firearm 100 such as but not limited to being along outside wall 60 or within main section 50.

Figure 16:
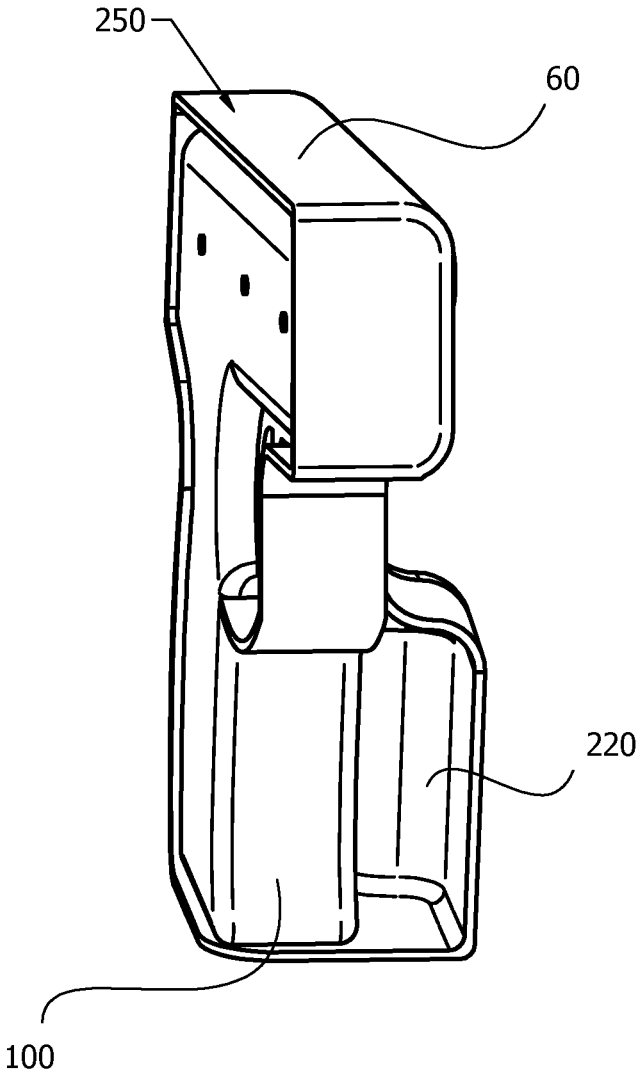
FIG. 16 is a side perspective view of the alternative embodiment access shroud of FIG. 14 with a firearm in the secured position.

Yet another embodiment of the present invention is shown in FIGS. 14 through 17. Access shroud 250 is shown having an access section 220 which is offset from main section 50. As best seen in FIG. 16, offset access section 220 is spaced apart from firearm 100 when firearm 100 is secured to main section 50. The gap created by offset access section 220 allows a user's fingers to gain easy access to frame 106, again suitable for particular versions, styles and models of firearm 100. A square style of frame 106 can benefit from access shroud 250.

Figure 6:
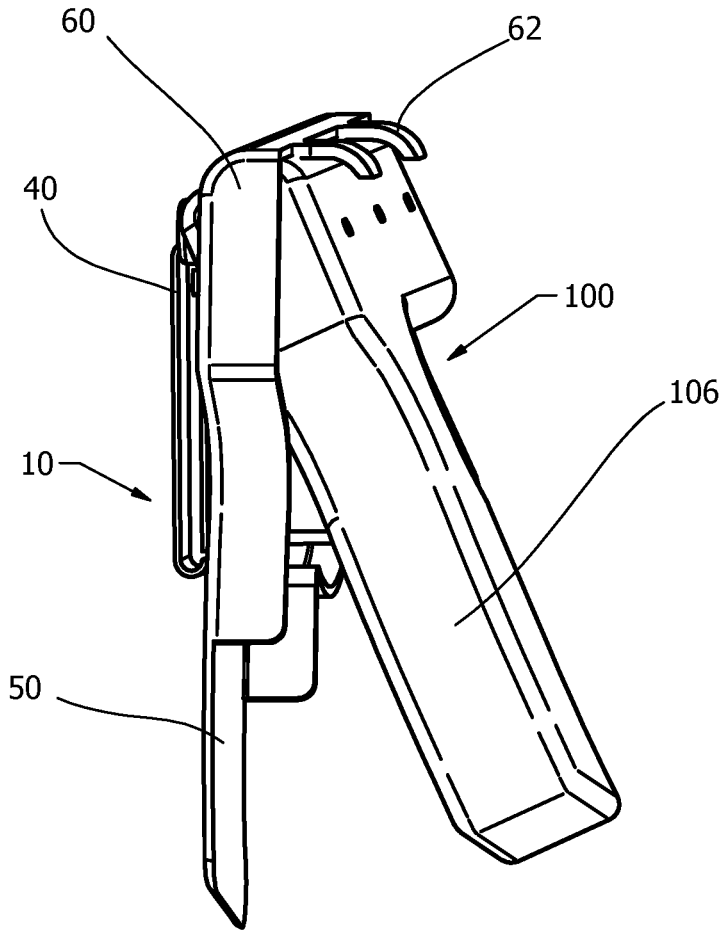
FIG. 6 is rear perspective view of the holster of FIG. 1 and showing the firearm in a partially secured position.

To use novel holster assembly 10, the user can attach firearm 100 before or after attaching holster 10 to the desired surface via clip 40. Firearm 100 is placed against shroud 20. Firearm 100 may be placed directly, or can be rotated in place as shown in FIG. 6 by first inserting a portion of firearm 100. Optional capture wall 62 may facilitate insertion of firearm 100 by providing additional contact structure to barrel section 102. In the natural way of handling firearm 100, the user has his or her hand on frame 106. By placing firearm 100 against shroud 20, magnets 70 pull firearm 100 towards surface 50. Essentially, the user can simply push firearm 100 towards their own body and firearm 100 becomes safe and secure. Optional trigger stop protrusion 82 and block protrusion 84 keep trigger 104 from moving while in the secured position.

To remove firearm 100 from holster assembly 10, the user simply grabs firearm 100 in a natural fashion placing their palm against frame 106. With outside wall 60 optionally exposing frame 106, as shown in FIG. 1, frame 106 is easy for the user to grab. With the user holding frame 106, the user can simply rotate firearm 100 outward as shown in FIG. 6, or pull it straight out. Rotating firearm 100 about the general axis of barrel section 102 efficiently breaks the magnetic force between one or more magnet 70 and firearm 100. While rotating firearm 100 the user's trigger finger is naturally in close proximity to trigger 104 and ready to fire firearm 100. A small rotation of firearm 100 exposes trigger 104 and moves it away from trigger stop protrusion 82 and block protrusion 84. More rapidly than the prior art, the user can extract and deploy firearm 100. With the present invention, a user can gain access to move firearm 100 and move to the desired forward shooting position in one movement, unlike the multiple up and out motions of the prior art.

While the magnetic holster herein described constitute preferred embodiments of the invention, it is to be understood that the invention is not limited to these precise form of assemblies, and that changes may be made therein without departing from the scope and spirit of the invention.

The invention claimed is:

1. A firearm holster system comprising:

a shroud in close fit to a 3D shape of a removable firearm, said shroud having a main section, a perimeter, and an outside wall extending from said main section in the direction of said firearm along at least half of said perimeter;

said main section having a magnet cavity corresponding to a barrel section of said firearm;

a barrel magnet attached to said magnet cavity for magnetically securing the firearm to the shroud; and, a clip attached to said main section and extending in a direction opposite of said outside wall; wherein the firearm is removable from the shroud only in a direction perpendicular to the main section.

2. The firearm holster system of claim 1, further comprising a frame magnet cavity corresponding to a frame section of said firearm.

3. The firearm holster system of claim 1, wherein said main section includes a trigger protrusion extending in the direction of said outside wall.

4. The firearm holster system of claim 1, wherein said main section includes an offset access section extending in the direction opposite of said outside wall and creating a gap between said shroud and a frame section of said firearm.

5. The firearm holster system of claim 1, wherein said clip includes a plurality of rotation ridges.

6. The firearm holster system of claim 1, wherein a capture wall extends from said outside wall over a portion of said barrel section of said firearm.

7. The firearm holster system of claim 1, wherein said barrel magnet is below a top surface of said main section.

8. A firearm holster system comprising:

a shroud having a main section having a perimeter corresponding to a removable firearm having a frame and a barrel;

an outside wall protruding from said main section along at least a half of said perimeter and in close fit to a 3D shape of said firearm;

one or more magnets securely attached to a magnet cavity of said shroud and below a top surface of said shroud for magnetically securing the firearm to the shroud; and, a clip member extending from said shroud in a direction opposite to said outside wall; wherein the firearm is removable from the shroud only in a direction perpendicular to the main section.

9. The firearm holster system of claim 8, wherein said main section includes a trigger protrusion extending from said main section in the same direction as said outside wall.

10. The firearm holster system of claim 8, wherein said main section includes an offset access section extending in the direction opposite of said outside wall and creating a gap between said shroud and said frame.

11. The firearm holster system of claim 8, wherein said shroud includes a plurality of rotation ridges.

12. The firearm holster system of claim 8, wherein a capture wall extends from said outside wall over a portion of said main section.

13. The firearm holster system of claim 8, wherein said one or more magnets is below a top surface of said main section.

* * * * *